US012221976B1

(12) United States Patent
Kilchyk et al.

(10) Patent No.: US 12,221,976 B1
(45) Date of Patent: Feb. 11, 2025

(54) RADIAL IMPELLER WITH MAXIMIZED INDUCER AREA

(71) Applicant: Hamilton Sundstrand Corporation, Charlotte, NC (US)

(72) Inventors: Viktor Kilchyk, Lancaster, NY (US); Brent J. Merritt, Southwick, MA (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 18/366,238

(22) Filed: Aug. 7, 2023

(51) Int. Cl.

| | |
|---|---|
| ***F04D 29/28*** | (2006.01) |
| ***F04D 17/02*** | (2006.01) |
| ***F04D 17/08*** | (2006.01) |
| ***F04D 17/10*** | (2006.01) |
| ***F04D 23/00*** | (2006.01) |
| ***F04D 29/24*** | (2006.01) |
| ***F04D 29/32*** | (2006.01) |
| ***F04D 29/38*** | (2006.01) |
| ***F04D 29/54*** | (2006.01) |

(52) U.S. Cl.
CPC ..... *F04D 29/284* (2013.01); *F04D 17/10* (2013.01); *F04D 17/02* (2013.01); *F04D 17/08* (2013.01); *F04D 23/003* (2013.01); *F04D 29/242* (2013.01); *F04D 29/247* (2013.01); *F04D 29/325* (2013.01); *F04D 29/38* (2013.01); *F04D 29/384* (2013.01); *F04D 29/544* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,345,875 | A * | 8/1982 | Charpentier | F03B 3/00 415/143 |
| 4,867,633 | A * | 9/1989 | Gravelle | F04D 29/167 415/113 |
| 5,139,391 | A * | 8/1992 | Carrouset | F04D 29/44 416/177 |
| 8,147,208 | B2 | 4/2012 | Hagshenas et al. | |
| 9,441,486 | B2 * | 9/2016 | Davey | F25J 1/0022 |
| 10,451,087 | B2 | 10/2019 | Richards | |
| 10,590,792 | B2 | 3/2020 | Daller et al. | |
| 2015/0377026 | A1 * | 12/2015 | Lefevre | F04D 29/284 416/244 R |
| 2016/0312787 | A1 * | 10/2016 | Sato | B21K 3/04 |
| 2019/0285080 | A1 | 9/2019 | Metz et al. | |
| 2020/0132079 | A1 * | 4/2020 | Vlastuin | F04D 17/122 |
| 2021/0010478 | A1 * | 1/2021 | Masaki | F04D 29/30 |
| 2021/0207563 | A1 * | 7/2021 | Salenbien | F01D 25/285 |

* cited by examiner

*Primary Examiner* — Binh Q Tran
(74) *Attorney, Agent, or Firm* — CANTOR COLBURN LLP

(57) ABSTRACT

A rotor assembly is provided and includes a two-piece rotor impeller and a rotor shaft. The two-piece rotor impeller includes a blade section and a forward section, which is connected to the blade section. The rotor shaft includes an aft section at which the rotor shaft terminates. The aft section is directly attached to the forward section of the rotor impeller. The blade section includes a converging blade configured to converge to a point with a minimized internal diameter (ID).

17 Claims, 2 Drawing Sheets

RADIAL IMPELLER WITH MAXIMIZED INDUCER AREA

BACKGROUND

The present disclosure relates to radial impellers and, in particular, to a radial impeller with a maximized induced area.

In a gas turbine engine, inlet air is compressed in a compressor and then transferred to a combustor as compressed air. Within the combustor, the compressed air is mixed with fuel and combusted to generated high-pressure and high-temperature working fluid. This working fluid is directed into a turbine where the working fluid interacts with aerodynamic elements to be expanded for power generation. The generated power causes a rotor to rotate, which drives the compressor and/or a generator.

SUMMARY

According to an aspect of the disclosure, a rotor assembly is provided and includes a two-piece rotor impeller and a rotor shaft. The two-piece rotor impeller includes a blade section and a forward section, which is connected to the blade section. The rotor shaft includes an aft section at which the rotor shaft terminates. The aft section is directly attached to the forward section of the rotor impeller. The blade section includes a converging blade configured to converge to a point with a minimized internal diameter (ID).

In accordance with additional or alternative embodiments, the blade section and the forward section are connected by at least one or more of a threaded connection, a bolted connection, a brazed connection, a welded connection and an adhesive connection.

In accordance with additional or alternative embodiments, the blade section and the forward section are formed of different materials.

In accordance with additional or alternative embodiments, the blade section includes polymeric material and the forward section includes metallic material.

In accordance with additional or alternative embodiments, the blade section extends aft from the forward section.

In accordance with additional or alternative embodiments, the point at which the converging blade of the blade section converges is defined along a rotational axis of the rotor shaft.

In accordance with additional or alternative embodiments, the blade section of the rotor impeller includes the converging blade and an exit blade, the converging blade extends aft from the forward section and converges toward the point with a non-linear profile and the non-linear profile includes a steep forward portion, a shallow aft portion and a curved portion axially interposed between the steep forward portion and the shallow aft portion.

In accordance with additional or alternative embodiments, the blade section of the rotor impeller includes the converging blade and an exit blade and the converging blade extends aft from an aft edge of the exit blade by a length which is not more than 1/10 of a diameter of the exit blade.

In accordance with additional or alternative embodiments, the aft section of the rotor shaft is connected to the forward section of the rotor impeller by a threaded connection.

According to an aspect of the disclosure, a rotor assembly is provided and includes a two-piece rotor impeller and a rotor shaft. The two piece rotor impeller includes a blade section and a forward section, which is connected to the blade section. The rotor shaft includes an aft section at which the rotor shaft terminates. The aft section is directly attached to the forward section of the rotor impeller. The blade section includes a converging blade configured to converge to a point with a zeroed internal diameter (ID).

In accordance with additional or alternative embodiments, the blade section and the forward section are connected by at least one or more of a threaded connection, a bolted connection, a brazed connection, a welded connection and an adhesive connection.

In accordance with additional or alternative embodiments, the blade section and the forward section are formed of different materials.

In accordance with additional or alternative embodiments, the blade section includes polymeric material and the forward section includes metallic material.

In accordance with additional or alternative embodiments, the blade section extends aft from the forward section.

In accordance with additional or alternative embodiments, the point at which the converging blade of the blade section converges is defined along a rotational axis of the rotor shaft.

In accordance with additional or alternative embodiments, the blade section of the rotor impeller includes the converging blade and an exit blade, the converging blade extends aft from the forward section and converges toward the point with a non-linear profile and the non-linear profile includes a steep forward portion, a shallow aft portion and a curved portion axially interposed between the steep forward portion and the shallow aft portion.

In accordance with additional or alternative embodiments, the blade section of the rotor impeller includes the converging blade and an exit blade and the converging blade extends aft from an aft edge of the exit blade by a length which is not more than 1/10 of a diameter of the exit blade.

In accordance with additional or alternative embodiments, the aft section of the rotor shaft is connected to the forward section of the rotor impeller by a threaded connection.

According to an aspect of the disclosure, a rotor assembly is provided and includes a two-piece rotor impeller and a rotor shaft. The two-piece rotor impeller includes a blade section and a forward section, which is connected to the blade section. The blade section includes an exit blade and a converging blade. The rotor shaft is rotatable about a rotational axis thereof and includes an aft section at which the rotor shaft terminates. The aft section is directly attached to the forward section of the rotor impeller. The converging blade of the blade section is configured to converge with a non-linear profile to a point defined along the rotational axis and aft of an aft edge of the exit blade with a zeroed internal diameter (ID).

In accordance with additional or alternative embodiments, the converging blade of the blade section extends aft from the aft edge of the exit blade by a length which is not more than 1/10 of a diameter of the exit blade.

Additional features and advantages are realized through the techniques of the present disclosure. Other embodiments and aspects of the disclosure are described in detail herein and are considered a part of the claimed technical concept. For a better understanding of the disclosure with the advantages and the features, refer to the description and to the drawings.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

In many applications, such as air cycle machines (ACMs) of supersonic aircrafts, maximizing speed may be required to achieve required performance level of a turbo-expander. This has recently led to development of relatively small rotors for maximum mass flow rate. For high rotor speed (NS) rotors, increasing flow rate tends to be challenging however due unfavorable exducer angles and/or exducer chocking. To minimize these issues, it has been found that exducer area for flow should be maximized.

Maximizing exducer area for flow presents further challenges. For example, the exducer area cannot typically be larger than a shroud outer diameter, less a minimum hub diameter that has been generally held constant. This is because, in typical machine, support at an impeller eye dictates the minimum hub diameter. Therefore, the only choice for maximizing exducer area has been to maximize the shroud outer diameter, which requires a substantial modification of rotor design. These challenges can be exacerbated by the need for rotor balance and the additional need to service all dynamic loads (i.e., on a plane).

Thus, as will be described below, a minimized or zeroed rotor hub internal diameter (ID) is provided for use in turbomachinery. The minimized or zeroed rotor hub ID is achieved through the use of a one-piece or two-piece rotor impeller to which a rotor shaft is directly coupled. The one-piece or two-piece rotor impeller has a blade section that converges to a point at a rotational axis of the rotor shaft with a minimized or zeroed ID at that point without sacrificing balance and the ability to service dynamic loads.

Figure 1:
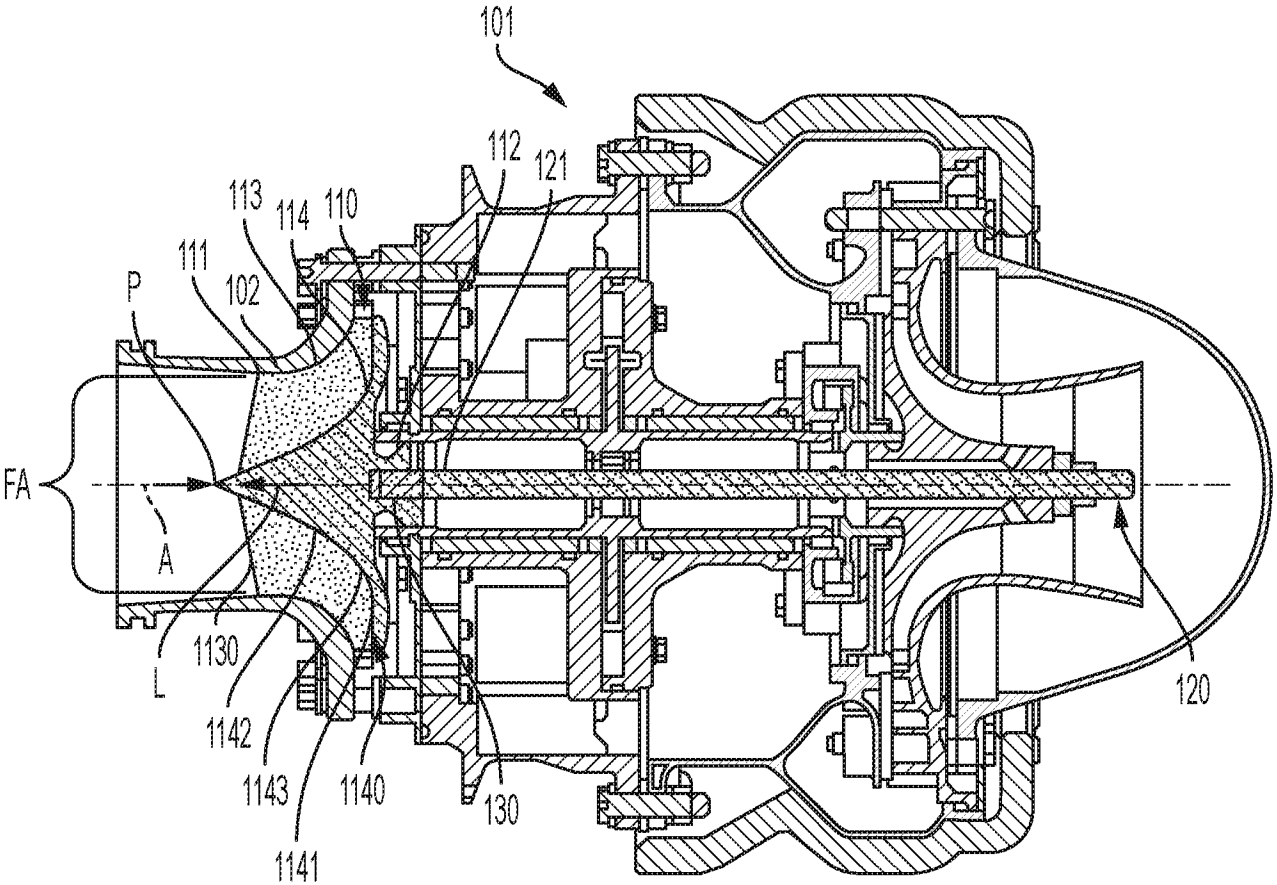
FIG. 1 is a side view of a rotor assembly in accordance with embodiments.

With reference to FIG. 1, a rotor assembly 101 is provided and includes a rotor impeller 110 and a rotor shaft 120. The rotor impeller 110 can be a one-piece rotor impeller and includes a blade section 111 and a forward section 112 from which the blade section 111 extends in the aft direction. The rotor shaft 120 is rotatable about a rotational axis A thereof and includes an aft section 121 at which the rotor shaft 120 terminates. The aft section 121 is directly attached to the forward section 112 of the rotor impeller 110 by, e.g., a threaded connection 130. The blade section 111 of the rotor impeller 110 includes an exit blade 113 and a converging blade 114 that is configured to converge to a point P with a minimized or zeroed ID. The point P can be defined along the rotational axis A. For purposes of clarity and brevity, the following description will relate to the case of the converging blade 114 converging to the point P with the zeroed ID.

In accordance with embodiments, as shown in FIG. 1, since the converging blade 114 converges to the point with the zeroed ID, a flow area FA of the rotor assembly 101 can be increased without changing a diameter of the outer shroud 102.

As shown in FIG. 1, the converging blade 114 extends in the aft direction aft from the forward section 112 and converges toward the point P with a non-linear profile 1140. The non-linear profile 1140 can include a steep forward portion 1141, a shallow aft portion 1142 and a curved portion 1143 that is axially interposed between the steep forward portion 1141 and the shallow aft portion 1142.

In accordance with embodiments, the converging blade 114 extends aft from an aft edge 1130 of the exit blade 113 by a length L which is not more than 1/10 of a diameter D of the exit blade 113.

Figure 2:
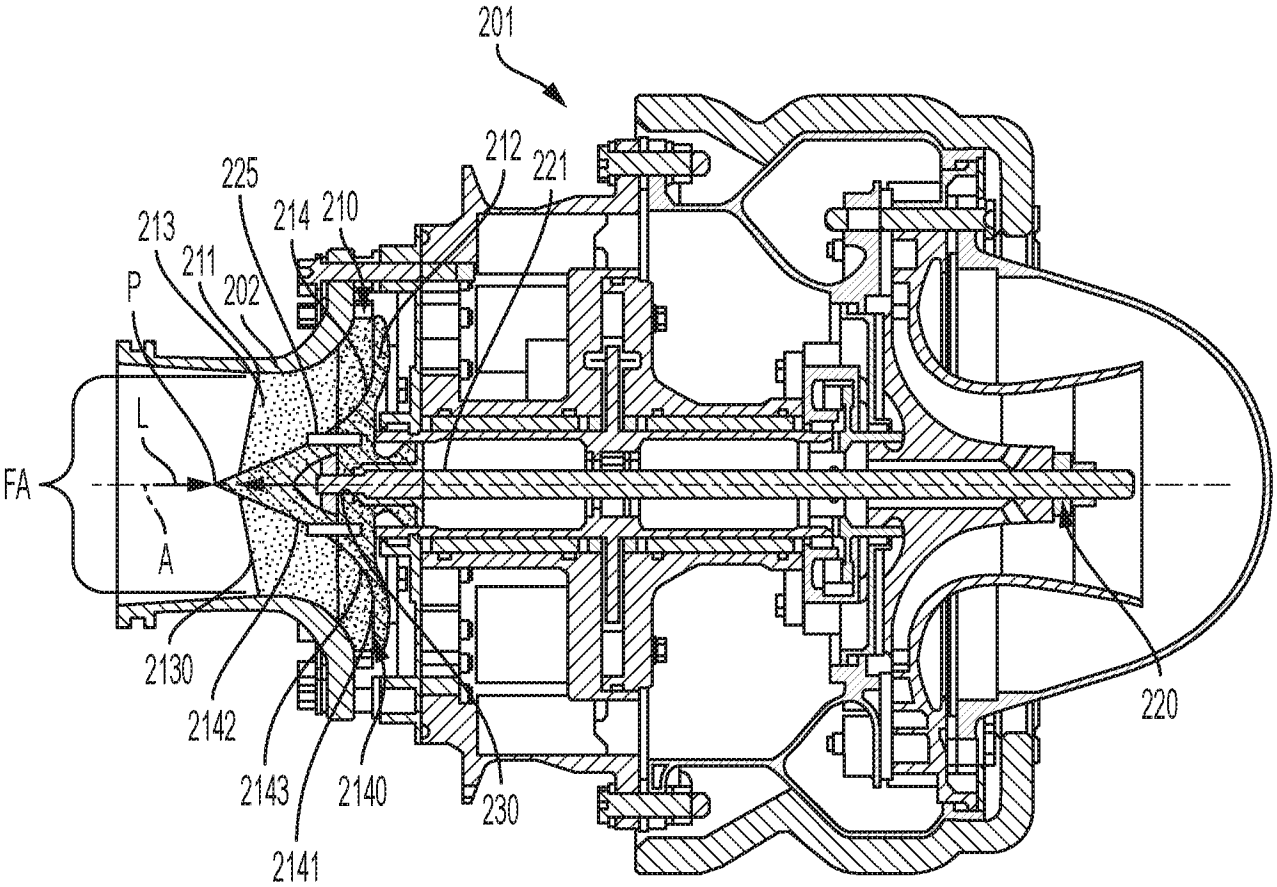
FIG. 2 is a side view of a rotor assembly in accordance with embodiments.

With reference to FIG. 2, a rotor assembly 201 is provided and includes a two-piece rotor impeller 210 and a rotor shaft 220. The two-piece rotor impeller 210 includes a blade section 211 and a forward section 212, which is connected to the blade section 211 and from which the blade section 211 extends in the aft direction. The forward section 212 and the blade section 211 can be connected by at least one or more of a threaded connection, a bolted connection, a brazed connection, a welded connection and an adhesive connection 225. The rotor shaft 220 is rotatable about a rotational axis A thereof and includes an aft section 221 at which the rotor shaft 220 terminates. The aft section 221 is directly attached to the forward section 212 of the rotor impeller 210 by, e.g., a threaded connection 230. The blade section 211 of the rotor impeller 210 includes an exit blade 213 and a converging blade 214 that is configured to converge to a point P with a minimized or zeroed ID. The point P can be defined along the rotational axis A. For purposes of clarity and brevity, the following description will relate to the case of the converging blade 214 converging to the point P with the zeroed ID.

In accordance with embodiments, the blade section 211 and the forward section 212 can be formed of different materials. For example, the blade section 211 can include polymeric material and the forward section 212 can include metallic material.

In accordance with embodiments, as shown in FIG. 1, since the converging blade 214 converges to the point with the zeroed ID, a flow area FA of the rotor assembly 201 can be increased without changing a diameter of the outer shroud 202.

As shown in FIG. 2, the converging blade 214 extends in the aft direction aft from the forward section 212 and converges toward the point P with a non-linear profile 2140. The non-linear profile 2140 can include a steep forward portion 2141, a shallow aft portion 2142 and a curved portion 2143 that is axially interposed between the steep forward portion 2141 and the shallow aft portion 2142.

In accordance with embodiments, the converging blade 214 extends aft from an aft edge 2130 of the exit blade 213 by a length L which is not more than 1/10 of a diameter D of the exit blade 213.

Technical effects and benefits of the present disclosure are the provision of a rotor assembly with improved rotor extruder angles and corresponding aerodynamic performance. This leads to improved stage efficiency, increasing choking area (i.e., by about 15% which in turn leads to reduced choking incidence) and an increased operating margin.

The corresponding structures, materials, acts and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the technical concepts in the form disclosed. Many modifications and variations will be apparent to those of ordinary skill in the art without departing from the scope and spirit of the disclosure. The embodiments were chosen and described in order to best explain the principles of the disclosure and the practical application and to enable others of ordinary skill in the art to understand the disclosure for various embodiments with various modifications as are suited to the particular use contemplated.

While the preferred embodiments to the disclosure have been described, it will be understood that those skilled in the art, both now and in the future, may make various improvements and enhancements which fall within the scope of the claims which follow. These claims should be construed to maintain the proper protection for the disclosure first described.

What is claimed is:

1. A rotor assembly, comprising:

a two-piece rotor impeller comprising a blade section and a forward section, which is connected to the blade section; and a rotor shaft comprising an aft section at which the rotor shaft terminates, the aft section being directly attached to the forward section of the rotor impeller, the blade section comprising a converging blade configured to converge to a point with a minimized internal diameter (ID) and an exit blade, wherein:

the converging blade extends aft from the forward section and converges toward the point with a non-linear profile, and the non-linear profile comprises a steep forward portion, a shallow aft portion and a curved portion axially inte d between the steep forward portion and the shallow aft portion.

2. The rotor assembly according to claim 1, wherein the blade section and the forward section are connected by at least one or more of a threaded connection, a bolted connection, a brazed connection, a welded connection and an adhesive connection.

3. The rotor assembly according to claim 1, wherein the blade section and the forward section are formed of different materials.

4. The rotor assembly according to claim 3, wherein:

the blade section comprises polymeric material, and the forward section comprises metallic material.

5. The rotor assembly according to claim 1, wherein the blade section extends aft from the forward section.

6. The rotor assembly according to claim 1, wherein the point at which the converging blade of the blade section converges is defined along a rotational axis of the rotor shaft.

7. A rotor assembly, comprising:

a two-piece rotor impeller comprising a blade section and a forward section, which is connected to the blade section; and a rotor shaft comprising an aft section at which the rotor shaft terminates, the aft section being directly attached to the forward section of the rotor impeller, the blade section comprising a converging blade configured to converge to a point with a minimized internal diameter (ID), wherein:

the blade section of the rotor impeller comprises the converging blade and an exit blade, and the converging blade extends aft from an aft edge of the exit blade by a length which is not more than 1/10 of a diameter of the exit blade.

8. The rotor assembly according to claim 1, wherein the aft section of the rotor shaft is connected to the forward section of the rotor impeller by a threaded connection.

9. A rotor assembly, comprising:

a two-piece rotor impeller comprising a blade section and a forward section, which is connected to the blade section; and a rotor shaft comprising an aft section at which the rotor shaft terminates, the aft section being directly attached to the forward section of the rotor impeller, the blade section comprising a converging blade configured to converge to a point with a zeroed internal diameter (ID) and an exit blade, wherein the converging blade extends aft from the forward section and converges toward the point with a non-linear profile and the non-linear profile comprises a steep forward portion, a shallow aft portion and a curved portion axially interposed between the steep forward portion and the shallow aft portion.

10. The rotor assembly according to claim 9, wherein the blade section and the forward section are connected by at least one or more of a threaded connection, a bolted connection, a brazed connection, a welded connection and an adhesive connection.

11. The rotor assembly according to claim 9, wherein the blade section and the forward section are formed of different materials.

12. The rotor assembly according to claim 11, wherein:

the blade section comprises polymeric material, and the forward section comprises metallic material.

13. The rotor assembly according to claim 9, wherein the blade section extends aft from the forward section.

14. The rotor assembly according to claim 9, wherein the point at which the converging blade of the blade section converges is defined along a rotational axis of the rotor shaft.

15. A rotor assembly, comprising:

a two-piece rotor impeller comprising a blade section and a forward section, which is connected to the blade section; and a rotor shaft comprising an aft section at which the rotor shaft terminates, the aft section being directly attached to the forward section of the rotor impeller, the blade section comprising a converging blade configured to converge to a point with a minimized internal diameter (ID), wherein:

the blade section of the rotor impeller comprises the converging blade and an exit blade, and the converging blade extends aft from an aft edge of the exit blade by a length which is not more than 1/10 of a diameter of the exit blade.

16. The rotor assembly according to claim 9, wherein the aft section of the rotor shaft is connected to the forward section of the rotor impeller by a threaded connection.

17. A rotor assembly, comprising:

a two-piece rotor impeller comprising a blade section and a forward section, which is connected to the blade section, the blade section comprising an exit blade and a converging blade; and a rotor shaft that is rotatable about a rotational axis thereof and comprises an aft section at which the rotor shaft terminates, the aft section being directly attached to the forward section of the rotor impeller, the converging blade of the blade section being configured to converge with a non-linear profile to a point defined along the rotational axis and aft of an aft edge of the exit blade with a zeroed internal diameter (ID), wherein the converging blade of the blade section extends aft from the aft edge of the exit blade by a length which is not more than 1/10 of a diameter of the exit blade.

* * * * *